US011744342B2

(12) United States Patent
Nuzzo et al.

(10) Patent No.: US 11,744,342 B2
(45) Date of Patent: Sep. 5, 2023

(54) DEVICE FOR TREATING THE HAIR, AND RELATED METHOD

(71) Applicant: L'OREAL, Paris (FR)

(72) Inventors: Stefania Nuzzo, Saint Ouen (FR); Frédéric Woodland, Saint Ouen (FR); Eric Parris, Saint Ouen (FR); Gabin Vic, Saint Ouen (FR); Matteo Maletti, Piazzale Guerrino Maletti Scadiano (IT); Paul Pofcher, Santa Monica, CA (US); Jim Quinn, Venice, CA (US); Michael Rocha, Playa del Rey, CA (US)

(73) Assignee: L'OREAL, Paris (FR)

( * ) Notice: Subject to any disclaimer, the term of this patent is extended or adjusted under 35 U.S.C. 154(b) by 640 days.

(21) Appl. No.: 16/099,764

(22) PCT Filed: May 12, 2017

(86) PCT No.: PCT/EP2017/061461
§ 371 (c)(1),
(2) Date: Nov. 8, 2018

(87) PCT Pub. No.: WO2017/194737
PCT Pub. Date: Nov. 16, 2017

(65) Prior Publication Data

US 2019/0116952 A1 Apr. 25, 2019

(30) Foreign Application Priority Data

May 13, 2016 (EP) ..... 16305566

(51) Int. Cl.
*A45D 1/04* (2006.01)
*A45D 1/06* (2006.01)
(Continued)

(52) U.S. Cl.
CPC ..... *A45D 1/04* (2013.01); *A45D 1/06* (2013.01); *A45D 1/14* (2013.01); *A45D 2/001* (2013.01)

(58) Field of Classification Search
CPC ..... A45D 1/00; A45D 2001/002; A45D 2001/004; A45D 2001/006;
(Continued)

(56) References Cited

U.S. PATENT DOCUMENTS 10,912,363 B1 * 2/2021 Kanter ..... A45D 1/06
2004/0000319 A1 * 1/2004 Carballada ..... A45D 1/04 132/224
2006/0144414 A1 * 7/2006 Carballada ..... A45D 1/04 132/224
(Continued)

FOREIGN PATENT DOCUMENTS

CN 101258962 A 9/2008
CN 201349663 Y 11/2009
(Continued)

*Primary Examiner* — Cris L. Rodriguez
*Assistant Examiner* — Karim Asqiriba
(74) *Attorney, Agent, or Firm* — POLSINELLI PC

(57) ABSTRACT

The invention concerns a device (10) for treating the hair, comprising two arms (12, 4) that are able to move relative to one another between a first opened configuration for inserting hair between the arms (12, 14) and a second closed configuration for treating the hair, at least one of the arms (12, 14) comprising: —a shell, —a support housed in said shell, —a treatment plate supported by the support, —an electrical heating element received in a housing defined between the support and an inner face of the treatment plate, —a first sealing element sandwiched between the support and the treatment plate, —a second sealing element, wherein the second sealing element is sandwiched between the support and the shell.

19 Claims, 3 Drawing Sheets

(51) Int. Cl.
*A45D 2/00* (2006.01)
*A45D 1/14* (2006.01)

(58) Field of Classification Search
CPC ..... A45D 2001/008; A45D 2001/045; A45D 1/02; A45D 1/04; A45D 1/06; A45D 1/08; A45D 1/10; A45D 1/14; A45D 1/28; A45D 2/00; A45D 2/001; A45D 2/02; A45D 2/12; A45D 2/40; A45D 4/00; A45D 4/02; A45D 4/04; A45D 4/06; A45D 4/08; A45D 4/085; A45D 4/10; A45D 4/12; A45D 6/00; A45D 2006/005; A45D 6/02; A45D 6/04; A45D 6/12; A45D 6/20; A45D 7/00; A45D 7/02; A45D 2007/001; A45D 2007/004; A45D 20/00; A45D 20/08; A45D 20/28; A45D 20/30; A45D 20/38; A45D 2200/00; A45D 2200/051; F16J 15/00; F16J 15/02; F16J 15/06; F16J 15/10
USPC ..... 219/222, 225, 226
See application file for complete search history.

(56) References Cited

U.S. PATENT DOCUMENTS

2006/0201924 A1* 9/2006 Hirata ..... A45D 1/04 219/225
2006/0265899 A1* 11/2006 Renzo ..... D06F 58/04 34/603
2008/0178900 A1* 7/2008 Blyden ..... A45D 1/04 132/211
2011/0108052 A1 5/2011 Morgandi et al.
2015/0296950 A1* 10/2015 Everett, Jr. ..... A45D 2/001 132/269

FOREIGN PATENT DOCUMENTS

| | | | | |
|---|---|---|---|---|
| CN | 102048339 | A | | 5/2011 |
| CN | 202618704 | U | | 12/2012 |
| CN | 202800496 | U | | 3/2013 |
| CN | 103027465 | A | | 4/2013 |
| CN | 105077952 | A | | 11/2015 |
| CN | 105077953 | A | | 11/2015 |
| CN | 205018485 | U | | 2/2016 |
| EP | 1 661 480 | A1 | | 5/2006 |
| EP | 2319354 | A1 | | 11/2011 |
| EP | 244991 | A1 | | 5/2012 |
| JP | 3609064 | B2 | | 1/2005 |
| KR | 20110002616 | U | * | 3/2011 |
| WO | WO 2005/011434 | A1 | | 9/2006 |
| WO | WO 2013/013965 | A1 | | 1/2013 |
| WO | WO 2015/091043 | A2 | | 6/2015 |
| WO | WO-2015/091043 | A2 | | 6/2015 |
| WO | WO-2015/091043 | A3 | | 6/2015 |

* cited by examiner

DEVICE FOR TREATING THE HAIR, AND RELATED METHOD

CROSS REFERENCE TO RELATED APPLICATIONS

This application is a National Phase filing under 35 U.S.C. § 371 of PCT/EP2017/061461 filed on May 12, 2017; which in turn claims priority to Application No. 16305566.8 filed in Europe on May 13, 2016. The entire contents of each application are hereby incorporated by reference.

BACKGROUND OF DISCLOSURE

Technical Field

The present invention concerns a device for treating the hair, comprising two arms that are able to move relative to one another between a first opened configuration for inserting hair between the arms and a second closed configuration for treating the hair, at least one of the arms comprising:

- a shell,
- a support housed in said shell,
- a treatment plate supported by the support,
- an electrical heating element received in a housing defined between the support and an inner face of the treatment plate,
- a first sealing element sandwiched between the support and the treatment plate,
- a second sealing element.

Such a device is intended in particular for taking care of human keratinic fibers or for shaping the hair, for example for straightening the hair.

Background Art

During a treatment of the hair by a professional or a consumer, it is known to use irons with straightening heating plates which are moved along the length of the hair.

In some cases, the iron is used on wet hair or hair that is covered with a haircare cosmetic product.

More generally, the expression "cosmetic product" is understood to mean any product as defined in Regulation (EC) No 1223/2009 of the European Parliament and Council of 30 Nov. 2009 relating to cosmetic products.

During the passage of the iron on the hair, the water evaporates and generates steam. The cosmetic product fluidizes and flows along the straightening heating plates.

Significant malfunctions of the iron may occur if the steam or if the haircare cosmetic product passes into the electrical components of the iron, and creates short-circuits.

In order to partially offset this problem, EP 1 661 480 discloses an iron provided with one sealing gasket securing the iron heating plate, in order to improve the stream cutoff. The gasket is fitted around the heating plate of the iron.

Such an iron is not entirely satisfactory. In some cases, the sealing around the heating plate is not sufficient to prevent steam or heated cosmetic product to enter the inner volume of the iron, for example in the handling portion of the iron. The reliability of the iron may then be affected adversely.

BRIEF SUMMARY OF THE DISCLOSURE

One aim of the invention is to improve reliability of a hair treatment device and make the treatment of hair risk-free for the user handling the device, even when the treatment is carried out on wet hair and/or on hair onto which a fluid cosmetic product has been applied.

To this aim, the subject-matter of the invention is a device for treating the hair as defined above, characterized in that the second sealing element is sandwiched between the support and the shell.

The device according to the invention ensures in particular tightness of the handling portion, in order to entirely protect the electrical elements housed inside the device.

The combination of the first sealing element around the treatment plate and of the second sealing element interposed between the support and the shell of the arm, ensures a good resistance against water or cosmetic product ingress, in particular by preventing any runoff from passing into the arms of the device while it is being used.

The term "runoff" should be understood as a discharge of fluid from the hair, in particular under the effect of a wringing pressure and/or heat produced by the device for treating the hair.

The aforementioned second sealing element allows insulating and sealing the proximal end of the arm, by which the user handles the device, from the distal end of the arm.

The device according to the invention may comprise one or more of the following features, taken solely or according to any technically possible combination.

According to a particular arrangement, the support has an outer face supporting the treatment plate, the outer face delimiting the housing receiving the at least one electrical heating element, the first sealing element being disposed at the perimeter of the housing, the support having an inner face opposite to the outer face and defining an inner volume with the shell, the second sealing element being disposed in said inner volume.

The first sealing element directly protects the electrical heating element housed in the distal end of the support while the second sealing element prevents ingress of water and/or cosmetic product from the inner space below the support towards the housing in order to protect in particular the proximal end of the arm.

This configuration also makes it possible to prevent any risk of short-circuit in the device, in particular when electrical elements are housed both in the distal end and in the proximal end of the arm.

Advantageously, each arm has a first sealing element and a second sealing element.

Such a provision is also applicable when electrical elements are housed in each of the arms of the device.

According to one embodiment, the second sealing element is located along the perimeter of an inner face of the shell.

This allows avoiding any runoff between the support and the shell to leak into the proximal end of the arm, causing irreversible damages.

Advantageously, the second sealing element has a closed ring shape.

This special shape is particularly adapted for an adequate placement along the perimeter of an inner face of the shell.

Advantageously, the second sealing element is a gasket.

According to a particular arrangement, the arm comprises a third sealing element.

The arm may comprise a number of sealing elements arranged among the various components of the arm.

In particular, the third sealing element is located between a fastening element and the support or the shell.

This configuration allows avoiding any runoff between a fastening element, for example a screw, and the support, or eventually between a fastening element and the shell.

The configuration of the device and the arrangement of the seals make it possible to obtain a water or cosmetic product resistant device that meets precise standards, such as standard IPX4 in which the device is subjected to sprayed water and must maintain its proper operating state.

For example, the sealing element is made of a silicone elastomer or a rubber polymer.

According to one embodiment, the arm has a proximal end linked to the other arm and a distal end, the second sealing element being located in an area of an inner face of the shell, and separating said proximal end and said distal end of the arm.

This configuration allows avoiding any runoff between the support and the shell to leak into the proximal end of the arm, causing irreversible damages.

Advantageously, the second sealing element is a block.

This special shape is fitted for an adequate placement in an area of an inner face of the shell, and adapted to fill the empty space between the proximal end and the distal end of the arm.

The invention also concerns a cosmetic method for treating hair comprising the steps of:

providing a device as defined above, applying water and/or a cosmetic composition to the hair, heating the treatment plate with the electrical heating element, and passing the treatment plate of the device over the hair.

BRIEF DESCRIPTION OF THE SEVERAL VIEWS OF THE DRAWINGS

The invention will be better understood upon reading of the following description, given solely as an example, and made in reference to the appended drawings, in which.

Figure 1:
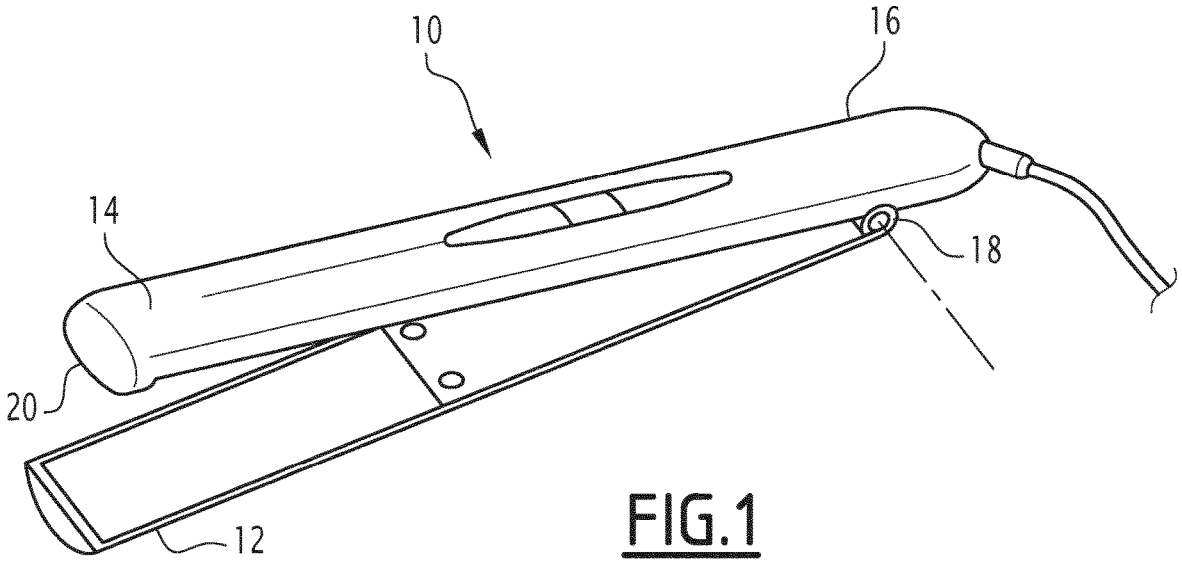
FIG. 1 is a perspective view of a device according to the invention.

A first device 10 for treating the hair according to the invention is illustrated in FIG. 1.

DETAILED DESCRIPTION OF THE DISCLOSURE

In this example, the device 10 for treating the hair is a straightening iron. It comprises two arms 12, 14 and a hinge 18 connecting the arms 12, 14 at their respective proximal ends 16. The arms 12, 14 are able to move relative to one another around the hinge 18 between a first opened configuration for inserting hair between the arms 12, 14, shown in FIG. 1, and a second closed configuration for treating the hair.

Figure 2:
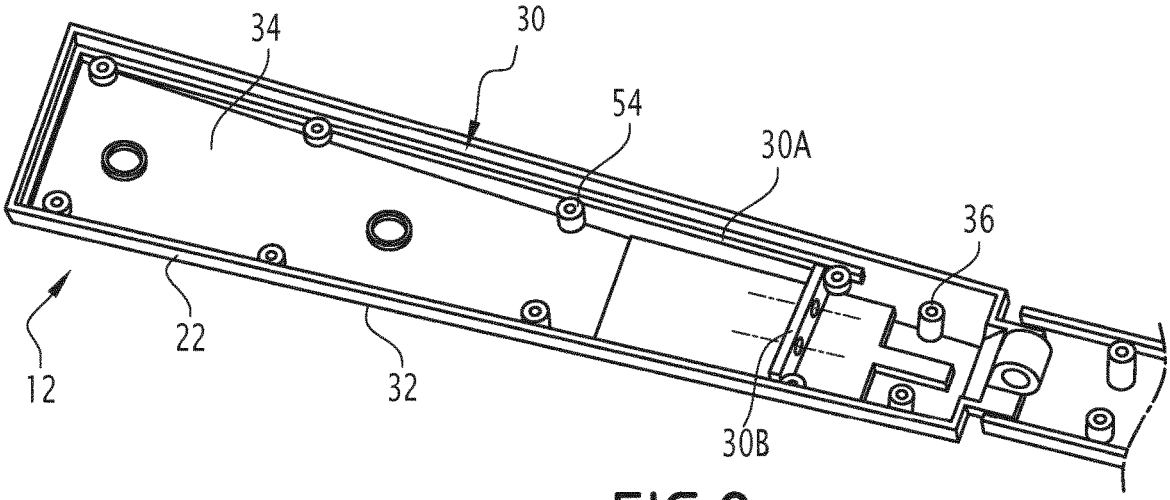
FIG. 2 is a perspective view of a shell of the device of FIG. 1.
Figure 3:
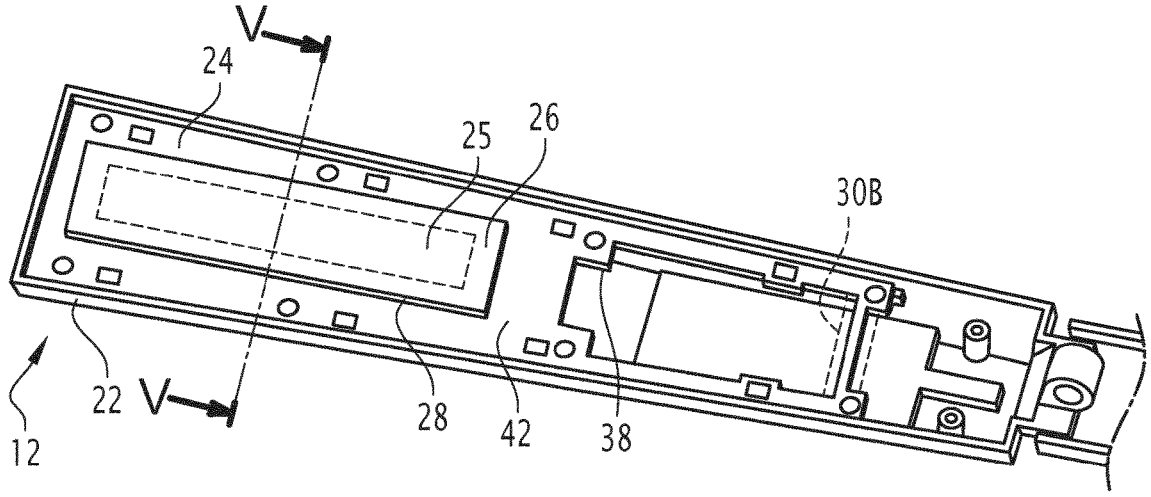
FIG. 3 is a view similar to FIG. 2 with a support and a treating plate arranged in the device according to the invention.
Figure 4:
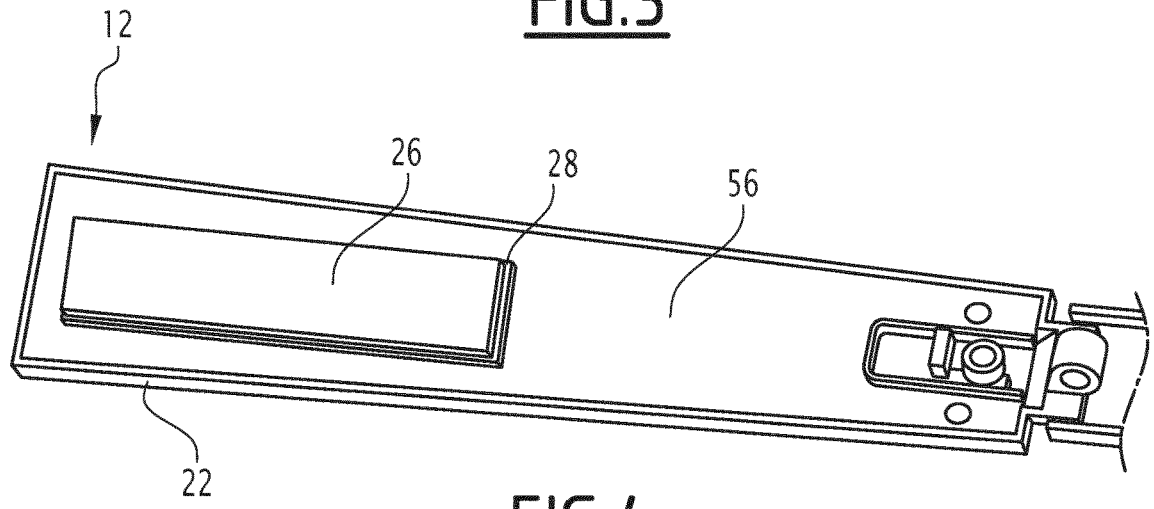
FIG. 4 is a view similar to FIG. 3 with a cover plate arranged in the device according to the invention.

As shown in FIGS. 2 and 3, at least one of the arms 12, 14, advantageously each arm 12, 14, comprises a shell 22, a support 24 housed in the shell 22, a treatment plate 26 supported by the support 24, and at least an electrical heating element 25 inserted between the support 24 and the treatment plate 26. It advantageously comprises a cover plate 56, as shown in FIG. 4.

The arm 12, 14 further comprises a first sealing element 28 sandwiched between the support 24 and the treatment plate 26 and a second sealing element 30 sandwiched between the support 24 and the shell 22.

As illustrated in FIG. 2, the shell 22 comprises a hollow wall, defining an outer face 32 corresponding to the external surface of the arm 12, 14 and an inner hollow face 34. The shell 22 comprises several sockets 36 protruding on the inner face 34 of the shell 22 to receive the support 24.

The shell 22 has here a pseudo rectangular shape. In a variant, it may have an ovoid shape or another shape.

The support 24, as shown in FIG. 3, is housed in the shell 22. The support 24 here comprises a first peripheral plate 24A and a second central supporting plate 24B fixed at the center of the first peripheral plate 24A.

The support 24 has an inner face 38 facing the inner face 34 of the shell 22.

The first peripheral plate 24A of the support 24 comprises a central opening designed to receive the treatment plate 26, partially the first sealing element 28, and the second plate 24B.

Figure 5:
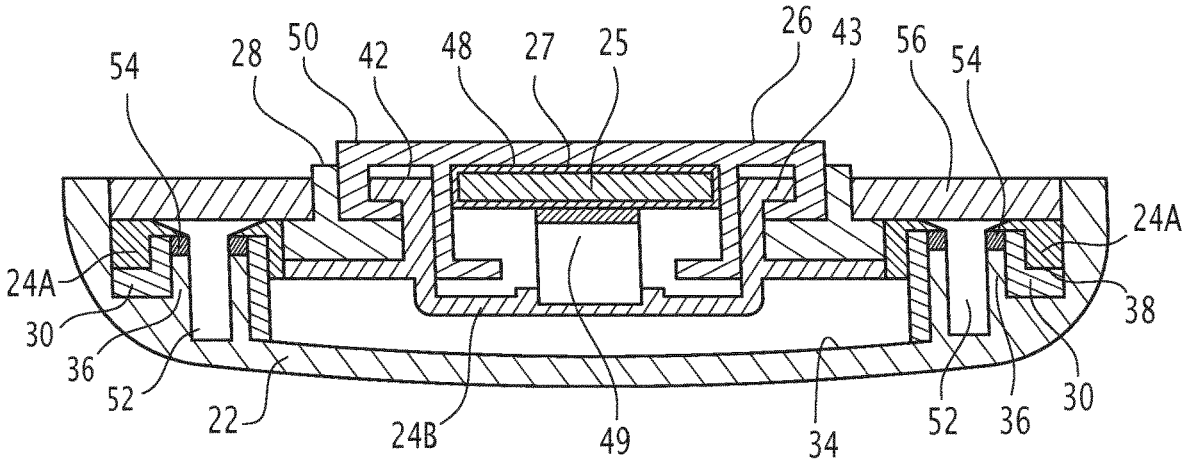
FIG. 5 is a transverse cross-section of FIG. 4.

As shown in FIG. 5, the second central supporting plate 24B is located in the central opening of the first peripheral plate 24A. It defines an outer face 42 designed to support the treatment plate 26. The outer face 42 defines a housing receiving the electrical heating element 25.

The housing is delimited by an inner face 48 of the treatment plate 26, by side walls extending substantially perpendicularly to the treatment plate 26, and by the outer face 42 of the second central supporting plate 24B of the support 24.

The second central supporting plate 24B is, for example, secured to the first peripheral plate 24A by clipping or by bonding with an adhesive.

The second central supporting plate 24B has side tongues 43 located in the upper part of the second central supporting plate 24B. The side tongues 43 fasten an inner flange of the treatment plate 26 with the second central supporting plate 24B and compress the first sealing element 28 between the inner flange of the treatment plate 26 and the outer surface of the second central supporting plate 24B.

The treatment plate 26 has an outer face 50 which comes into contact with a hair lock during the hair treatment. The treatment plate 26 also has an inner face 48, opposite to the outer face 50, defining the upper side of the housing.

The treatment plate 26 can be made of metal, for example aluminum, or of ceramic.

The electrical heating element 25 is pressed against the inner face 48 of the treatment plate 26. In the example of FIG. 5, the arm 12, 14 comprises a spring 49 located into the housing between the electrical heating element 25 and the outer face 42 of the second central supporting plate 24B, to press the electrical heating element against the inner face 48 of the treatment plate 26. For example, the spring 49 is an inclined flexible blade.

The electrical heating element 25 is for example a heating resistance. It is preferably contacting the inner face 48 of the treatment plate 26 to ensure a temperature increase of the treatment plate 26.

In the example of FIG. 5, an electric insulator 27, for example a micanite cardboard taking the form of a thin leaf having electrical insulation properties and a thermal conductivity allowing heat transfer between the heating element 25 and the treatment plate 26, is placed around or/and surrounds the electrical heating element 25, in order to electrically protect the latter.

Advantageously, the arm 12, 14 comprises fastening elements 52 to secure the treatment plate 26 and the support 24 together. The fastening elements 52 are for example, screws or snap rings.

The first sealing element 28 is placed at the perimeter of the housing, between the treatment plate 26, the first peripheral plate 24A and the second central supporting plate 24B of the support 24. The first sealing element 28 is fitted to surround the treatment plate 26. It is at least partially covered by the cover 56.

The first sealing element 28 is preferably a gasket, for example made of a silicone, a rubber or a polymeric elastomer.

The second sealing element 30 is placed in the inner volume defined between the inner face 38 of the first peripheral plate 24A of the support 24 and the inner face 34 of the shell 22.

Advantageously, as shown in FIG. 2, the second sealing element 30 is located along the perimeter of the inner face 34 of the shell 22 at the bottom of the inner face 34.

In the embodiment shown in FIG. 2, the second sealing element 30 has a closed ring shape. It here comprises a "U"-shaped sealing segment 30A and a transverse sealing segment 30B, closing the "U"-shaped sealing segment 30A. In another variant, the "U"-shaped sealing segment 30A is made in one single piece of material with the transverse sealing segment 30B.

The "U"-shaped sealing element 30A follows the shape of the perimeter of the distal end 20 of the arm 12, 14.

The transverse sealing segment 30B is placed in contact with the inner face 42 of the first peripheral plate 24A of the support 24, for closing the "U"-shaped sealing segment 30A.

Advantageously, the transverse sealing segment 30B comprises at least a passage opening for receiving an electrical cord of the electrical heating element 25.

Advantageously, the "U"-shaped sealing segment 30A and the transverse sealing segment 30B are respectively secured to the inner face 34 of the shell 22 and the inner face 42 of the first peripheral plate 24A by bonding.

Advantageously, the arm 12, 14 comprises at least a third sealing element 54, for example a sealing washer.

The third sealing element 54 is here disposed between a fastening element 52 and the support 24. In a variant, the third sealing element 54 could also be placed between a fastening element 52 and the shell 22. In another variant, the third sealing element is made in one single piece of material with the "U"-shaped second sealing segment 30A.

The sealing elements 28, 30, 52 are advantageously made of a silicone elastomer or a rubber polymer.

The cover plate 56, as illustrated in FIGS. 4 and 5 is applied above the outer face 42 of the first peripheral plate 24A. It covers the first peripheral plate 24A around the treatment plate 26. It extends to a peripheral edge of the shell 22.

An example of cosmetic method carried out with the device 10 according to the invention will be now described.

The method comprises the steps of applying water and/or cosmetic composition to the hair and then passing the device 10 over the hair.

Initially, in the application step, the user wets a hair lock and/or applies a cosmetic product on the hair lock.

The user subsequently activates the device 10 to electrically power the electric heating element 25. The treatment plate 26 is heated via the electrical heating element 25, for example at a temperature comprised between 50° C. and 230° C. Preferentially, the temperature is comprised between 80° C. and 180° C.

The user then introduces a hair lock between the two arms 12, 14 of the device 10 in the opened position and closes it manually in order to pinch the hair lock against the treatment plate 26.

When the wet hair lock comes into contact with the hot treatment plate 26, the water evaporates and creates steam. The cosmetic product fluidizes and streams along the distal end 20 of the arm 12, 14.

The first sealing element 28 prevents any runoff to leak inside the device 10 via the space between the treatment plate 26 and the support 24 or the cover plate 56 disposed above the support 24.

When a significant runoff occurs, the second sealing element 30 prevents liquids to leak into the inner part of the device 10 via a peripheral space between the support 24 or the cover plate 56, and/or the shell 22.

In case of liquid infiltration into the arm 12, 14, the second sealing element 30 avoids any runoff to penetrate into the proximal end 16 of the arm 12, 14 and thus insulates the electrical elements housed in this proximal end 16.

As a result, the device 10 is completely secured from fluid infiltration both into the distal end 20 and the proximal end 16 of the arm 12, 14. Thus, all electrical elements housed inside the device 10 are protected against irreversible damages, like short circuits.

In a variant, the first sealing element 28 is placed around the treatment plate 26 and/or has a different shape.

In another variant, the second sealing element 30 has another shape. For example it is "U"-shaped.

Figure 6:
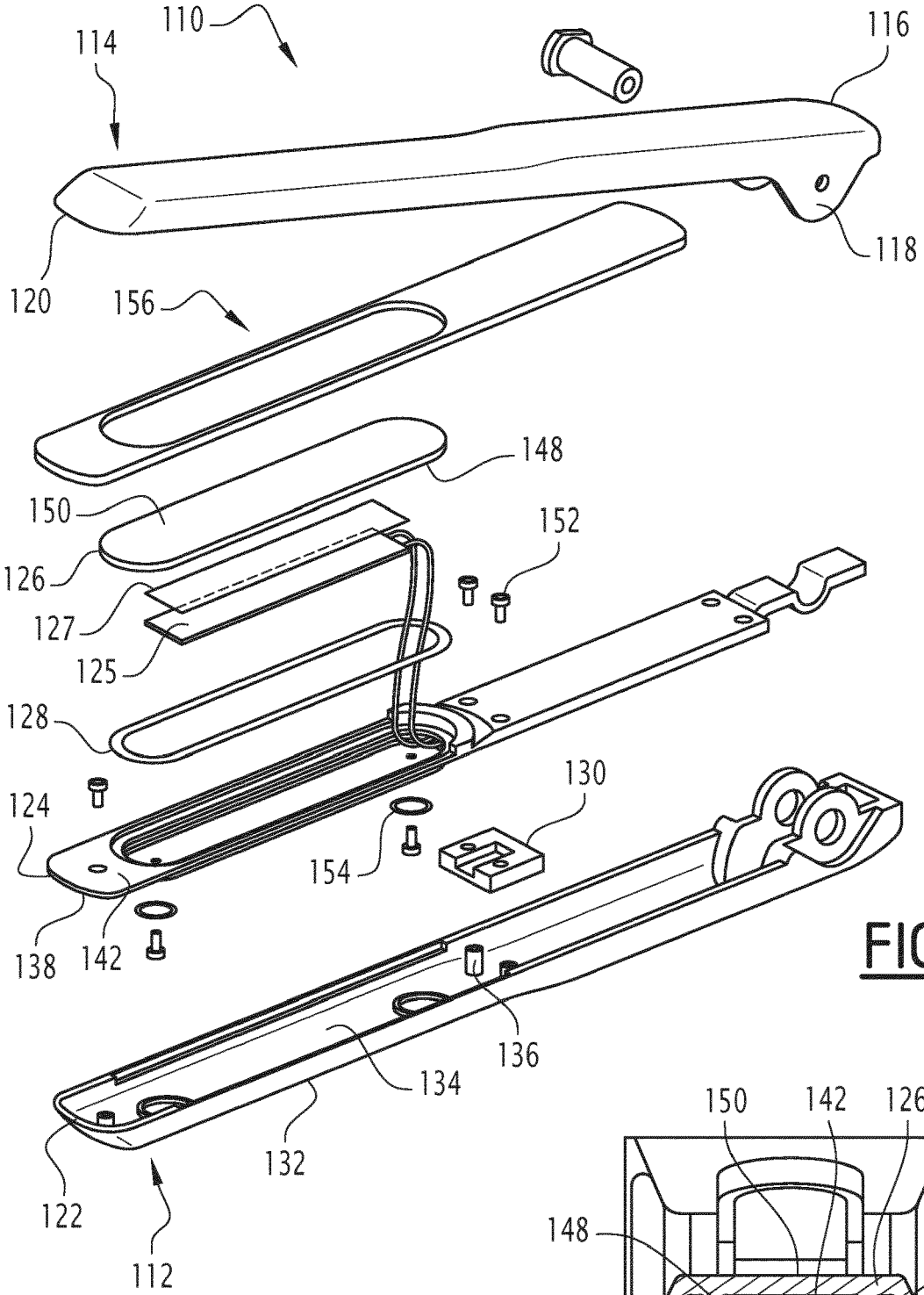
FIG. 6 is an exploded view of another device according to the invention.
Figure 7:
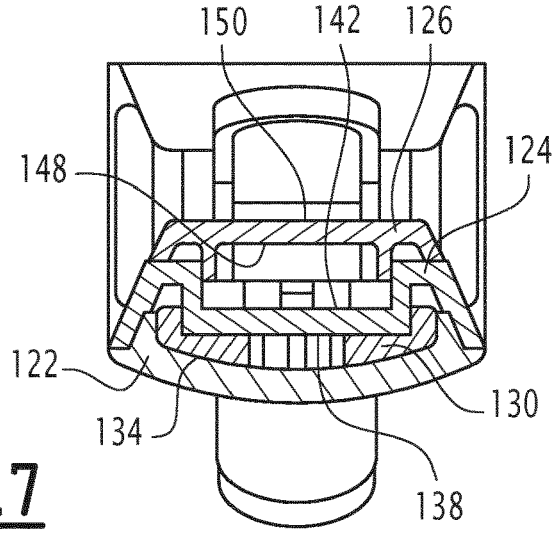
FIG. 7 is a transverse cross-section of the device of FIG. 6.

A second device 110 for treating the hair, according to the invention is illustrated in FIGS. 6 and 7.

Just like the first device according to the invention, the device 110 for treating the hair is a straightening iron. It comprises two arms 112, 114 and a hinge 118 connecting the arms 112, 114 at their respective proximal ends 116. The arms 112, 114 are able to move relative to one another around the hinge 118 between a first opened configuration for inserting hair between the arms 112, 114 and a second closed configuration for treating the hair.

At least one of the arms 112, 114, advantageously each arm 112, 114 comprises a shell 122, a support 124 housed in the shell 122, a treatment plate 126 supported by the support 124, and at least an electrical heating element 125 inserted between the support 124 and the treatment plate 126. It advantageously comprises a cover plate 156.

The arm 112, 114 further comprises a first sealing element 128 sandwiched between the support 124 and the treatment plate 126 and a second sealing element 130 sandwiched between the support 124 and the shell 122.

As illustrated in FIG. 6, the shell 122 comprises a hollow wall, defining an outer face 132 corresponding to the external surface of the arm 112, 114 and an inner hollow face 134. The shell 122 comprises several sockets 136 protruding on the inner face 134 of the shell 122 to receive the support 124.

The shell 122 has here a pseudo rectangular shape. In a variant it may have ovoid-shaped or another shape.

The support 124 is housed in the shell 122. The support 124 comprises a plate having an inner face 138 facing the inner face 134 of the shell 122.

The inner faces 134, 138 delimit between them an inner volume between the support 124 and the shell 122. The support 124 further has an outer face 142, designed to support the treatment plate 126. The outer face 142 defines a housing receiving the electrical heating element 125.

The housing is delimited by an inner face 148 of the treatment plate 126, by side walls extending substantially perpendicularly to the treatment plate 126, and by the outer face 142 of the support 124.

The treatment plate 126 has an outer face 150 which comes into contact with a hair lock during the hair treatment. The treatment plate 126 also has an inner face 148, opposite to the outer face 150, defining the upper side of the housing.

The treatment plate 126 can be made of metal, for example aluminum, or of ceramic.

The electrical heating element 125 is for example a heating resistance. It is preferably contacting the inner face 148 of the treatment plate 126 to ensure a temperature increase of the treatment plate 126.

In the example of FIG. 7, an electric insulator 127, for example a micanite cardboard having electrical insulation properties and a thermal conductivity allowing heat transfer between the heating element 125 and the treatment plate 126, is placed above the electrical heating element 125, in order to electrically protect the latter. In another embodiment, the electric insulator 127 can take the form of a thin leaf placed around or/and surrounding the heating element 125.

Advantageously, the arm 112, 114 comprises fastening elements 152 to secure the treatment plate 126 and the support 124 together. The fastening elements 152 are for example, screws or snap rings.

The first sealing element 128 is placed at the perimeter of the housing, and is fitted to surround the treatment plate 126.

The first sealing element 128 is preferably a gasket, for example made of a silicone, a rubber or a polymeric elastomer.

The second sealing element 130 is placed in the inner volume defined between the inner face 138 of the support 124 and the inner face 134 of the shell 122.

Advantageously, the second sealing element 130 is located in an area of the inner volume, which separates the proximal end 116 and the distal end 120 of the arm 112, 114.

In the embodiment shown in FIG. 6, the second sealing element 130 is a block.

As shown in FIG. 6, the block has a pseudo rectangular shape. It has more generally a complementary shape into the inner face 134 of the shell 122. It is placed in the inner volume in contact with the support 124 on its upper surface and in contact with the shell 122 on its lower and lateral surface.

The block fills at least one transverse section of the inner volume. It thus defines a proximal compartment and a distal compartment in the inner volume, which are tightly sealed one from another.

In the example of FIG. 6, the block extends below the proximal end 116 of the housing. Its length taken along a longitudinal axis of the arm 112, 114 is smaller than 20% of the length of the arm 112, 114.

Advantageously, the block comprises at least a passage opening for receiving an electrical cord of the electrical heating element 125.

Advantageously at least one socket 136 passes through the block.

Advantageously, the arm 112, 114 comprises at least a third sealing element 154, for example a sealing washer.

The third sealing element 154 is here disposed between a fastening element 152 and the support 124. In a variant, the third sealing element 154 could also be placed between a fastening element 152 and the shell 122.

The sealing elements 128, 130, 152 are advantageously made of a silicone elastomer or a rubber polymer.

In one embodiment, the cover plate 156, as illustrated in FIG. 6 is applied above the outer face 142 of the support 124. It covers the support 124 around the treatment plate 126. It extends to a peripheral edge of the shell 122.

An example of cosmetic method carried out with the device 110 according to the invention will be now described.

The method comprises the steps of applying water and/or cosmetic composition to the hair and passing the device 110 over the hair.

In the application step, the user wets a hair lock and/or applies a cosmetic product on the hair lock.

The user subsequently activates the device 110 to electrically power the electric heating element 125. The treatment plate 126 is heated via the electrical heating element 125, for example at a temperature comprised between 50° C. and 230° C. Preferentially, the temperature is comprised between 80° C. and 180° C.

The user then introduces a hair lock between the two arms 112, 114 of the device 110 in the opened position and closes it manually in order to pinch the hair lock against the treatment plate 126.

When the wet hair lock comes into contact with the hot treatment plate 126, the water evaporates and creates steam. The cosmetic product fluidizes and streams along the distal end 120 of the arm 112, 114.

The first sealing element 128 prevents any runoff to leak inside the device 110 via the space between the treatment plate 126 and the support 124 or the cover plate 156 disposed above the support 124.

In case of liquid infiltration into the arm 112, 114, the second sealing element 130 avoids any runoff to penetrate into the proximal end 116 of the arm 112, 114 and thus insulates the electrical elements housed in this proximal end 116.

As a result, the device 110 is completely secured from fluid infiltration both into the distal end 120 and the proximal end 116 of the arm 112, 114. Thus, all electrical elements housed inside the device 110 are protected against irreversible damages, like short circuits.

In a variant, the first sealing element 128 is placed between the support 124 and the treatment plate 126 and/or has a different shape.

The zone of the device which is in contact with hair and/or water and/or formula is generally watertight and it can particularly meet the requirements of standards IPX4. Such a device can be used quite safely on hair that is very wet or covered with cosmetic product. It ensures reliability to the use and makes the treatment of hair risk-free for the user handling the device.

The invention is not limited to a straightening iron as the device for treating the hair. The device may be any appliance for taking care of, shaping, dyeing or bleaching the hair and/or any electrical iron in which runoff is likely to occur and so which requires sealing elements with respect to this runoff.

The expression "comprising a" is synonymous with "comprising at least one".

The invention claimed is:

1. A device for treating the hair, comprising two arms that are able to move relative to one another between a first opened configuration for inserting hair between the arms and a second closed configuration for treating the hair, at least one of the arms comprising:

a shell, a support housed in said shell, a treatment plate supported by the support, an electrical heating element received in a housing defined between the support and an inner face of the treatment plate, a first sealing element sandwiched between the support and the treatment plate, wherein the first sealing element is fitted to surround the treatment plate, the first sealing element having a closed shape and extending all around a perimeter of the treatment plate, a second sealing element, wherein the second sealing element is sandwiched between the support and the shell, and the first sealing element and second sealing element being two separate elements.

2. The device according to claim 1, wherein the support has an outer face supporting the treatment plate, the outer face delimiting the housing receiving the at least one electrical heating element, the first sealing element being disposed at the perimeter of the housing, the support having an inner face opposite to an outer face of the support and defining an inner volume with the shell, the second sealing element being disposed in said inner volume.

3. The device according to claim 2, wherein each arm has a first sealing element-and a second sealing element.

4. The device according to claim 2, wherein the second sealing element is located along the perimeter of an inner face of the shell.

5. The device according to claim 2, wherein the second sealing element has a closed shape.

6. The device according to claim 2, wherein the second sealing element is a gasket.

7. The device according to claim 1, wherein each arm has a first sealing element and a second sealing element.

8. The device according to claim 7, wherein the second sealing element is located along the perimeter of an inner face of the shell.

9. The device according to claim 1, wherein the second sealing element is located along the perimeter of an inner face of the shell.

10. The device according to claim 1, wherein the second sealing element has a closed shape.

11. The device according to claim 1, wherein the second sealing element is a gasket.

12. The device according to claim 1, wherein the arm comprises a third sealing element.

13. The device according to claim 12, wherein the third sealing element is located between a fastening element and the support or between a fastening element and the shell.

14. The device according to claim 1, wherein each sealing element is made of a silicone elastomer or a rubber polymer.

15. A cosmetic method for treating hair comprising the steps of:

providing a device according to claim 1, applying water and/or a cosmetic composition to the hair, heating the treatment plate with the electrical heating element, and passing the treatment plate of the device over the hair.

16. The device according to claim 1, wherein the first sealing element is configured to prevent a liquid to leak inside an inner part of the device via a space between the treatment plate and the support and the second sealing element is configured to prevent a liquid to leak inside the inner part of the device via a peripheral space between the support and the shell.

17. The device according to claim 1, wherein the support comprises a first peripheral plate and a second central supporting plate fixed at the center of the first peripheral plate, the first peripheral plate comprising a central opening designed to receive the treatment plate, partially the first sealing element, and the second plate.

18. The device according to claim 1, wherein the treatment plate is devoid of through openings.

19. A device for treating the hair, comprising two arms that are able to move relative to one another between a first opened configuration for inserting hair between the arms and a second closed configuration for treating the hair, at least one of the arms comprising:

a shell, a support housed in said shell, a treatment plate supported by the support, an electrical heating element received in a housing defined between the support and an inner face of the treatment plate, a first sealing element sandwiched between the support and the treatment plate, wherein the first sealing element is fitted to surround the treatment plate, the first sealing element having a closed shape and extending all around a perimeter of the treatment plate, a second sealing element, wherein the second sealing element is sandwiched between the support and the shell, wherein the first sealing element and the second sealing element are gaskets, wherein the first sealing element and the second sealing element are two distinct separate elements, wherein the second sealing element is located along the perimeter of an inner face of the shell, wherein the device further comprises a cover plate disposed above the support and the first sealing element being received in a peripheral space delimited by the cover plate, the treatment plate, and the support delimiting between them a peripheral space.

* * * * *